US007377311B2

(12) United States Patent
Scallen et al.

(10) Patent No.: US 7,377,311 B2
(45) Date of Patent: May 27, 2008

(54) WELLHEAD VALVES

(76) Inventors: Richard E. Scallen, 8506 N. Highway 14/16, Gillette, WY (US) 82716; Roy E. Knutson, Jr., #5 Middle Prong Rd., Gillette, WY (US) 82717-2604

( * ) Notice: Subject to any disclaimer, the term of this patent is extended or adjusted under 35 U.S.C. 154(b) by 182 days.

(21) Appl. No.: 11/375,117

(22) Filed: Mar. 15, 2006

(65) Prior Publication Data

US 2006/0213654 A1 Sep. 28, 2006

Related U.S. Application Data

(60) Provisional application No. 60/664,169, filed on Mar. 23, 2005.

(51) Int. Cl.
*E21B 33/068* (2006.01)

(52) U.S. Cl. ..... 166/86.2; 166/97.1; 166/75.14

(58) Field of Classification Search ..... 166/86.2, 166/86.3, 87.1, 97.1, 75.14; 175/218
See application file for complete search history.

(56) References Cited

U.S. PATENT DOCUMENTS

| | | | | |
|---|---|---|---|---|
| 3,554,480 | A | 1/1971 | Rowe | |
| 4,071,085 | A | 1/1978 | Grable et al. | |
| 4,582,293 | A | 4/1986 | Jones | |
| 4,583,569 | A | 4/1986 | Ahlstone | |
| 4,632,187 | A | 12/1986 | Deaton | |
| 4,802,143 | A * | 1/1989 | Smith | 367/82 |

(Continued)

FOREIGN PATENT DOCUMENTS

| | | | |
|---|---|---|---|
| GB | 2168463 | A | 6/1986 |
| GB | 2170330 | A | 7/1986 |
| GB | 2208301 | A | 3/1989 |
| GB | 2264313 | A | 8/1993 |
| WO | WO 95/06799 | | 3/1995 |

OTHER PUBLICATIONS

"Blowout Preventer", website: http://www.osha.gov/SLTC/etools/oilandgas/illustrated_glossary/blowout_preventer.html, 1 page, printed from the Internet on Feb. 4, 2005.

(Continued)

*Primary Examiner*—Jennifer H Gay
*Assistant Examiner*—Robert E Fuller
(74) *Attorney, Agent, or Firm*—Christopher Wood; Wood & Eisenberg, PLLC

(57) ABSTRACT

A safety valve system for removing down-hole tools from a coal-bed methane well. The system includes first and second horizontally opposed stuffer-blocks, a stuffer-box housing for housing the stuffer-blocks, a means for attaching said stuffer-box housing to a coal-bed methane wellhead, and a means for delivering fluid to move the stuffer-blocks between an open position and a closed position. In one embodiment, the safety valve system further includes a controller, at least one methane sensor, a stuffer-box position sensor, and a stuffer-block activation system. A control algorithm is stored on or in communication with the controller enabling the controller to control the position of the stuffer-blocks, moving the stuffer-blocks between an open and closed configuration, wherein the stuffer-blocks are maintained in an open configuration if the methane level is below a predetermined threshold level. The valve system may further comprise a free-rotating stripper-diverter atop of the valve system.

11 Claims, 19 Drawing Sheets

U.S. PATENT DOCUMENTS

| | | | | |
|---|---|---|---|---|
| 4,825,945 | A | 5/1989 | Smith | |
| 4,828,024 | A | 5/1989 | Roche | |
| 5,011,110 | A | 4/1991 | Le | |
| 5,251,870 | A | 10/1993 | Ward | |
| 5,316,086 | A | 5/1994 | DeMoss | |
| 5,575,451 | A | 11/1996 | Colvin et al. | |
| 5,746,249 | A | 5/1998 | Wright et al. | |
| 5,833,208 | A | 11/1998 | Lee, Jr. | |
| 5,875,841 | A | 3/1999 | Wright et al. | |
| 6,024,172 | A | 2/2000 | Lee | |
| 6,089,526 | A | 7/2000 | Olson | |
| 6,179,057 | B1 | 1/2001 | Fontana et al. | |
| 6,260,817 | B1 | 7/2001 | Lam et al. | |
| 6,296,225 | B1 | 10/2001 | Watts | |
| 6,354,385 | B1 * | 3/2002 | Ford et al. | 175/195 |
| 6,719,262 | B2 | 4/2004 | Whitby et al. | |
| 6,817,421 | B2 | 11/2004 | Dallas | |
| 6,843,463 | B1 | 1/2005 | McWhorter et al. | |
| 6,845,958 | B2 | 1/2005 | Wood et al. | |
| 2002/0062966 | A1 | 5/2002 | Allen | |
| 2002/0066875 | A1 | 6/2002 | Carlsen | |
| 2003/0066656 | A1 | 4/2003 | Hughes et al. | |
| 2004/0031940 | A1 | 2/2004 | Biester | |
| 2004/0084644 | A1 | 5/2004 | Wiedemann | |

OTHER PUBLICATIONS

"U Blowout Preventer", website: http://www.coopercameron.com/cgi-bin/cameron/products/productdetail.cfm?OID=1072351&pageid=cambrands&thismenu=menu1, 3 page, printed from the Internet on Feb. 4, 2005.

* cited by examiner

WELLHEAD VALVES

CROSS-REFERENCE TO RELATED APPLICATIONS

This application claims the benefit of priority from U.S. Provisional Patent Application Ser. No. 60/664,169, filed Mar. 23, 2005, the entire contents of which are incorporated herein by reference.

STATEMENT REGARDING FEDERALLY SPONSORED RESEARCH OR DEVELOPMENT

Not Applicable.

FIELD OF THE INVENTION

This invention relates generally to wellhead valves. More specifically, this invention relates to a new kind of wellhead valve. In one embodiment, the valve of the present invention is a wellhead safety valve for enabling safe maintenance procedures on coal-bed methane (CBM) wells such as, for example, the safe removal and/or replacement of a water pump from a coal-bed methane bore hole in open hole configuration. In another embodiment, the valve of the present invention is a valve that facilitates safe operation of a drill rig for redirecting cleanout and underreamers from a well.

BACKGROUND OF THE INVENTION

Coal-bed methane is a natural gas extracted from coal seams or adjacent sandstones. In a U.S. Geological Survey Fact Sheet (FS-019-97) published in 1997, it was reported that in the conterminous United States more than 700 trillion cubic feet (TCF) of coal-bed methane exists in place, with perhaps one seventh (i.e., about 100 TCF) economically recoverable with 1997 technology. Commercial production occurs in approximately 10 U.S. basins, including the San Juan, Black Warrior, and Central Appalachian Basins. The exploitation of coal-bed methane is now international with coal-bed gas projects in numerous locations in various countries outside the United States. Methane can be found in coal seams that have not been overly compressed by a large depth of overburden.

Coal seams, particularly at shallow depths, have large internal surface areas that can store large volumes of methane-rich gas; six or seven times as much as a conventional natural gas reservoir of equal rock volume can hold. Since methane-laden coal is found at shallow depths, wells are easy to drill and relatively inexpensive to complete. With greater depth, increased pressure closes fractures (cleats) in the coal, which reduces permeability and the ability of the gas to move through and out of the coal.

Methane bearing coal mined without first extracting the methane gas can give cause to safety and environmental concerns because methane gas is highly flammable and when released into the atmosphere contributes to global warming. According to FS-019-97, methane in the atmosphere has increased at a rate of about 1 percent per year for 15 years prior to the publication of FS-019-97.

Extraction of coal-bed methane, however, carries with it some technological, environmental and worker safety issues and costs. In a conventional natural oil or gas reservoir, for example, methane rich gas lies on top of the oil, which, in turn, lies on top of water. An oil or gas well draws only from the petroleum that is extracted without producing a large volume of water. In contrast, water permeates coal beds, and the resulting water pressure typically traps coal-bed methane within the coal. To produce methane from coal beds, water is typically drawn off to lower the pressure so that methane can flow out of the coal seam and into the well bore and thence to the surface for processing and/or storage, and onward transportation to customers.

A submersible water pump is typically used to pump water from methane bearing coal seams (the terms "seam" and "bed" are regarded here as equivalent terms). The submersible pump is lowered from the surface into a drilled well, and more typically into a drilled well bore at the bottom of the well, to pump out the water. Though submersible pumps are designed to operate with minimum maintenance, there are occasions when the submersible pump must be brought back up to the surface either for maintenance or for replacement with a new submersible water pump.

Extracting a submersible water pump from a CBM well involves considerable hazards. First, water is pumped down into the well to create positive pressure around the well bore at the bottom of the CBM well to stop methane from entering the well and thence making it to the top of the CBM well. The top of the CBM well is then partially removed to allow a work crew to bring the submersible pump to the surface as quickly as possible. In the intervening time between creating positive water pressure around the well bore and getting the submersible water pump to the surface, CBM methane may enter the well bore and make it to the surface, causing a serious hazard for the crew tasked with extracting the submersible water pump.

Thus, there is a strong need for an apparatus and methodology to enable the safe extraction of the submersible water pump without the risk of significant quantities of CBM methane getting to the top of the well.

The Applicant is unaware of inventions or patents, taken either singly or in combination, which are seen to describe the instant invention as claimed.

SUMMARY OF THE INVENTION

A safety valve system for removing down-hole tools (such as, but not limited to, a water pump) from a coal-bed methane well. The system comprises first and second horizontally opposed stuffer-blocks, a stuffer-box housing for housing the stuffer-blocks, a means for attaching said stuffer-box housing to a coal-bed methane wellhead, and a means for delivering fluid to move the stuffer-blocks between an open position and a closed position. In one embodiment, the safety valve system further comprises a controller, at least one methane sensor, a stuffer-box position sensor, and a stuffer-block activation system. A control algorithm is stored on or in communication with the controller enabling the controller to control the position of the stuffer-blocks, moving the stuffer-blocks between an open and closed configuration, wherein the stuffer-blocks are maintained in an open configuration if the methane level is below a predetermined threshold level. The valve system may further comprise a free-rotating stripper-diverter atop of the valve system.

FIGURES labeled 11 through to 14 speak to a further embodiment of the invention, wherein the valve of the invention includes a free-rotating stripper-diverter.

DETAILED DESCRIPTION OF THE PREFERRED EMBODIMENTS

This invention is directed to wellhead valves. More specifically, this invention relates to a new kind of wellhead valve. In one embodiment, the valve of the present invention is a wellhead safety valve for enabling safe maintenance procedures on coal-bed methane (CBM) wells such as, for example, the safe removal and/or replacement of a water pump from a coal-bed methane bore hole in open hole configuration. In another embodiment, the valve of the present invention is a valve enabling safe operation of a drill rig for redirecting cleanout and underreamers from a well.

The parts list (see attached pages labeled A through to C) constitutes part of the detailed specification.

Figure 1:
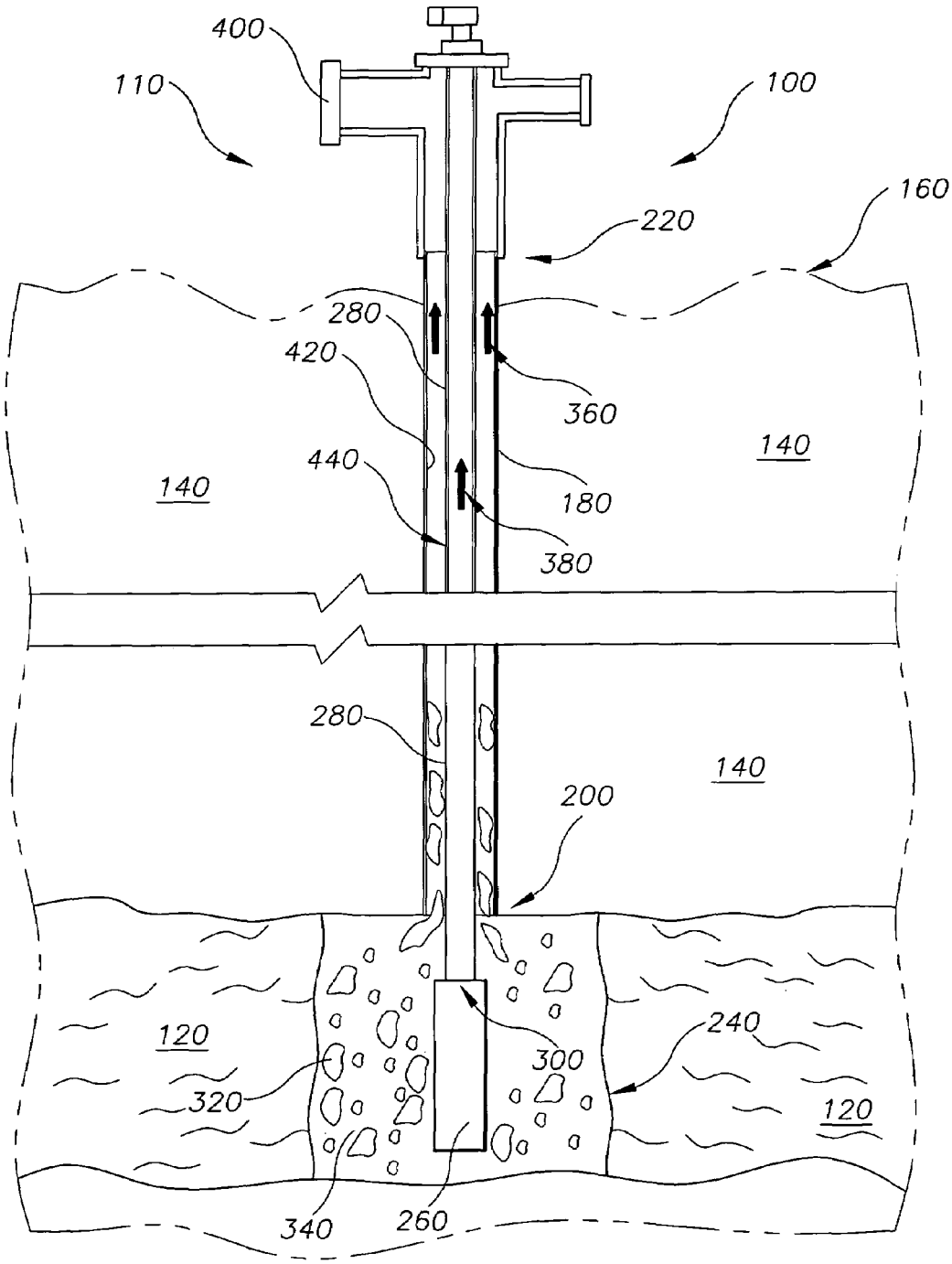
Fig. 1 (PRIOR ART)
FIG. 1 is a cross-sectional side environmental view of a prior art coal-bed methane well.

Referring initially to FIG. 1, a prior art coal-bed methane (CBM) well 100 of conventional construction is illustrated. The principles of operation of a CBM well 100 is found, for example, in U.S. Patent Publication Number 20040244988 published Dec. 9, 2004 to Y. M. Preston. Publication Number 20040244988 is herein incorporated by reference in its entirety. The terms "coal-bed derived methane", "CBM derived gas", "CBM methane", "CBM gas", "methane gas", "$CH_4$", "CH4", and "methane" are hereinafter regarded as equivalent terms.

CBM well 100 includes a wellhead 110 at the surface 160. The CBM well 100 provides access to a coal seam 120 buried under some overburden 140. The depth of overburden 140 covering a methane-bearing coal seam 120 is typically in the 400-3000 feet range. For a CBM well 100 to be productive, the amount of overburden 140 should not be so massive to render the coal seam 120 devoid of CBM gas. Any suitable drill technology is used to drill a borehole from the earth's surface 160. Once the bore is drilled, a well casing 180 may be inserted and sealed to provide a closed, stable flow path from an inlet 200 at the coal seam 120 to an outlet 220 at the surface 160. Once the well casing 180 is in place, bore-reaming equipment may be lowered into the CBM well 100 to cut the larger well bore 240 directly below the inlet 200. A submersible pump 260 is lowered and placed inside the bore 240 and used to pump water into water inlet 300 and thence to the wellhead 110 via conduit 280 and along water path 380.

CBM wells are found, for example; in the Montana Powder River Basin where numerous CBM wells have been drilled. CBM wells are also found at locations outside the continental USA where underground coal seams are rich in methane gas, i.e., coal seams which are not compressed to the point that they lack internal surface area, and hence devoid of commercially significant quantities of CBM gas.

Coal seams are typically aquifers. Often, the water within a coal seam aquifer inhibits the release of coal-bed methane gas. Thus, to permit methane contained in the coal seam 120 to escape up the well 100, the water pressure within the well 100 must be lowered. This process is known as dewatering a well. Dewatering is accomplished by pumping water from the well bore 240. Water 340 is pumped up water conduit 280 along water path 380. Depending on the flow of water within a coal seam aquifer 120, dewatering may take many months, and often takes more than a year. Dewatering the coal-bed seam 120 facilitates the production of methane gas from the coal-bed seam 120. It is understood in the art of coal-bed methane production that the amount and rate of dewatering should be carefully controlled by close monitoring and adjustment of a submersible water pump 260 to avoid interfering with methane production from well 100.

Coal-bed derived methane is drawn up the well 100. The level of output of the methane gas typically increases during the dewatering phase, followed by a stable production stage, followed by a decline in output of methane. In the prior art well 100, methane enters and rises up the well bore 240. If well operation is functioning properly, methane gas 320 escapes from water 340 in the well bore 240 and flows up path 360 to the CBM wellhead 110 at surface 160. Methane flow along path 360 may be diverted through a methane take-off 400 for processing and eventual shipment to customers. The gas flow path 360 may be defined as the gap, conduit, or annulus formed by the interior surface 420 of the well casing 180 and the exterior surface 440 of the water extraction conduit 280.

Figure 1A:
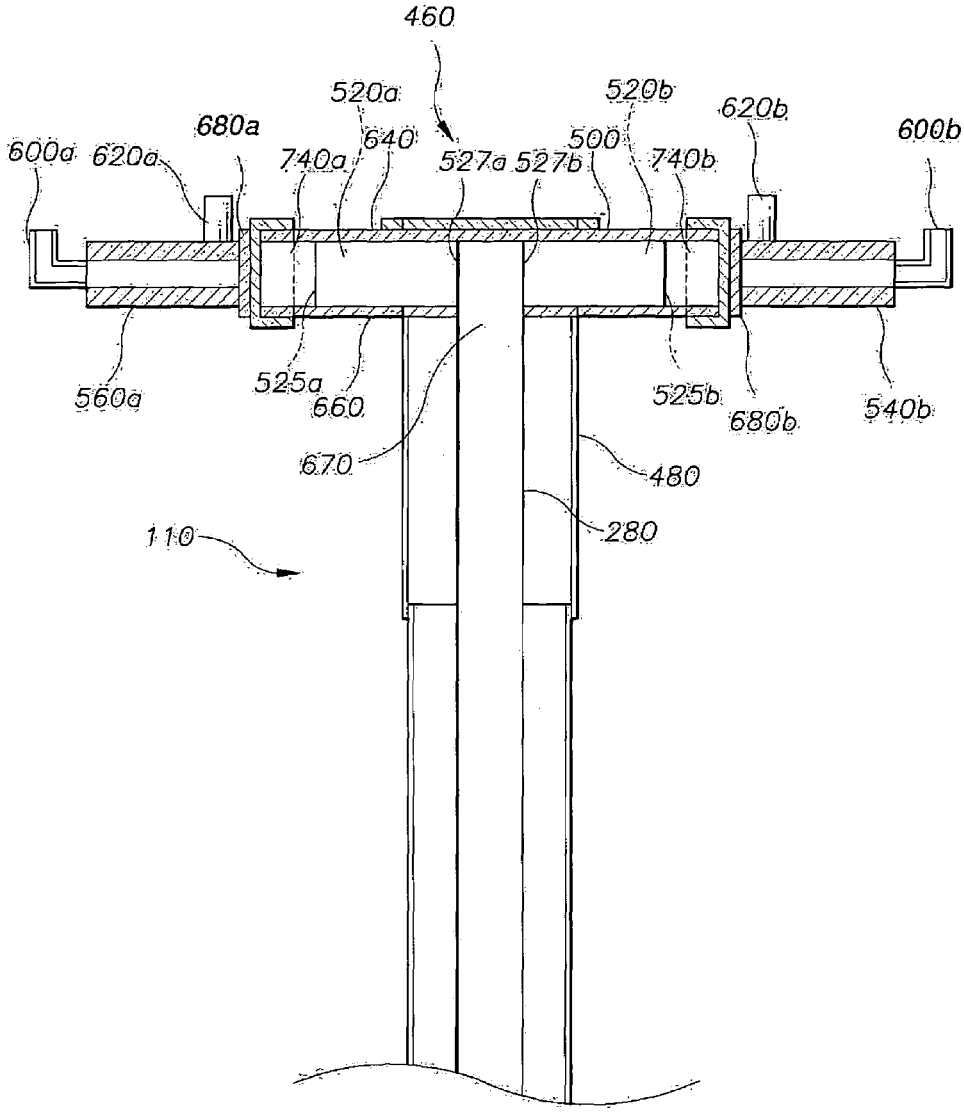
FIG. 1A is a cross-sectional side view of a coal-bed methane well, the top of which is fitted with a wellhead safety valve system, according to the present invention.

FIG. 1A shows a wellhead safety valve system 460 of the present invention atop wellhead 110. The wellhead safety valve system 460 of the present invention comprises a T-valve specially designed and configured to enable safe maintenance procedures such as the removal of the submersible water pump 260 and/or conduit tubing 280.

Referring to the FIGURES in general, and FIGS. 2 through 5 in particular, the wellhead safety valve system 460 comprises a stuffer-box housing 500, horizontally opposed first and second stuffer-blocks 520*a* and 520*b*, and first and second working fluid in/out members 540*a* and 540*b*. The working fluid in/out members 540*a* and 540*b* respectively comprise working fluid inlet ports 600*a* and 600*b*, and working fluid outlet ports 620*a* and 620*b*, respectively. It should be understood that the term "working fluid" refers to any suitable fluid for moving the opposed stuffer-blocks 520*a* and 520*b* between an open position and a closed position (see, for example, FIGS. 3 and 2, respectively; and FIG. 14, which shows a different embodiment of the present invention labeled as "460*b*", but in an open and closed position with respect to the stuffer-blocks 520*a* and 520*b*).

The stuffer-box housing 500 has upper and lower sidewalls 640 and 660, opposite rear-end sidewalls 680*a* and 680*b*, and opposite sidewalls 700 and 720. The container walls 640, 660, 680*a*, 680*b*, 700 and 720 collectively define stuffer-box interior volume 740. The working fluid in/out members 540*a* and 540*b* are in operable communication with the interior 740 (represented by alpha-numeral labels 740*a* and 740*b* in FIGS. 1A and 2, and represented by alpha-numeral labels 740*a*, 740*b*, and 740*c* in FIG. 7) via rear-end sidewalls 680*a* and 680*b*, respectively, and more particularly via apertures 690*a* and 690*b* in rear-end sidewalls 680*a* and 680*b*, respectively (see FIG. 7).

Figure 2:
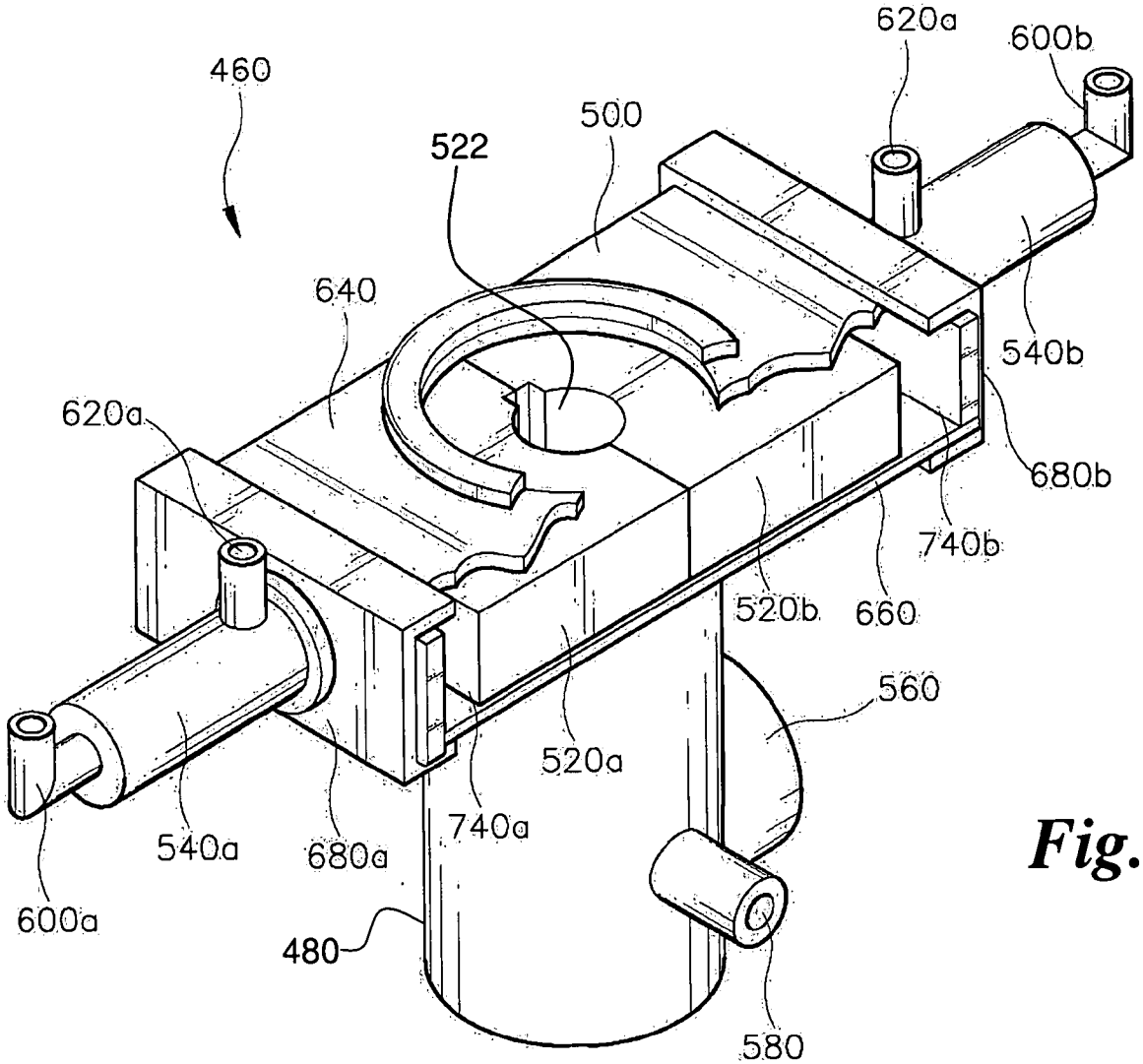
FIG. 2 is a partially cutaway perspective view of a wellhead safety valve system in closed configuration according to the present invention.
Figure 3:
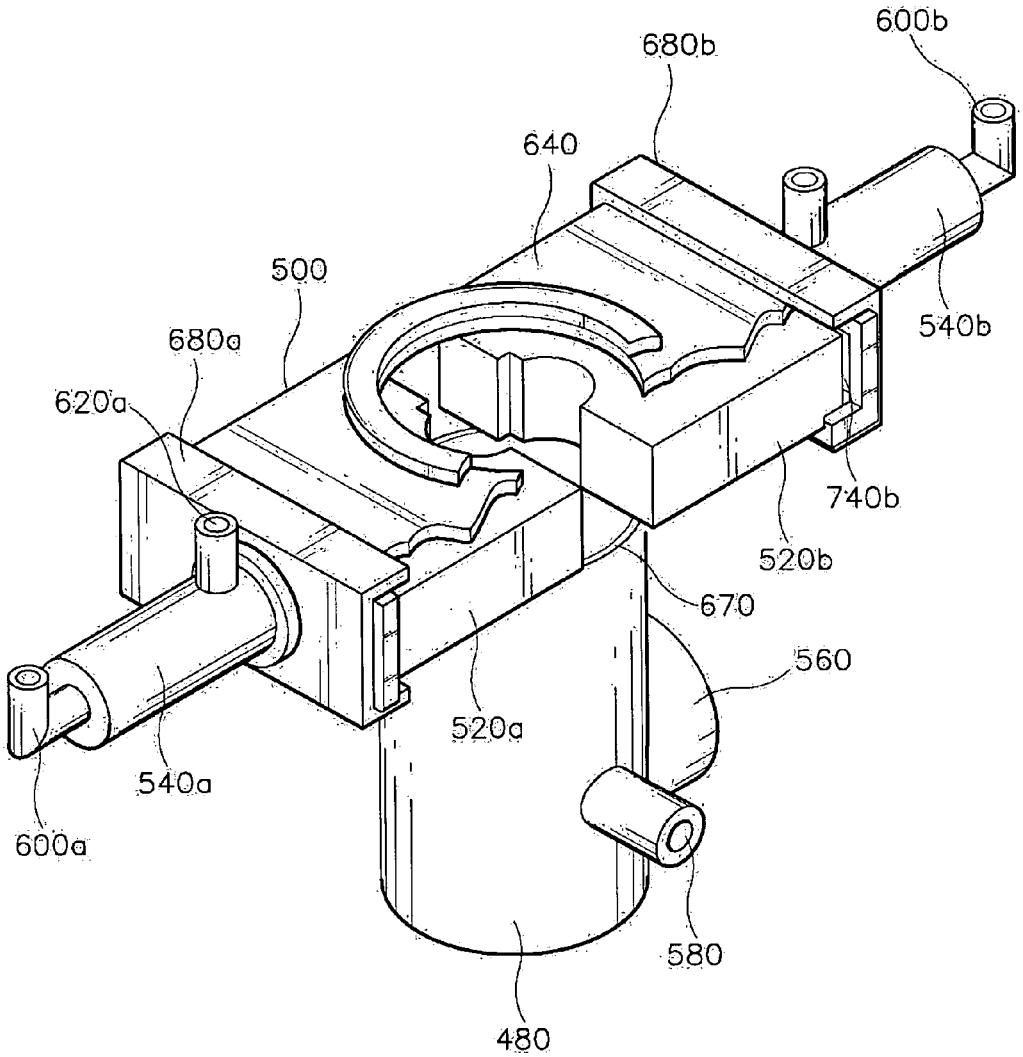
FIG. 3 is a partially cutaway perspective view of the wellhead safety valve system shown in FIG. 2 in open configuration.

In the closed configuration, stuffer-blocks 520*a* and 520*b* define an aperture 522 (see FIG. 2). It will be understood by a person of ordinary skill in the art that the dimensions and shape of the aperture 522 can vary according to what the operator wants to haul out of the wellhead 110. The aperture 522 is typically above and centered over aperture 670 in lower sidewall 660 (see FIG. 3). However, the aperture 522 can be off-center with respect to aperture 670.

The wellhead safety valve system 460 comprises optional cylindrical member 480. Optional cylindrical member 480 is in operable communication with interior 740 via an aperture 670 in lower sidewall 660. It will be understood that the optional member 480 acts as a coupling device for coupling the valve system 460 to the wellhead 110. For example, cylindrical member 480 may comprise threads suitably located so that the cylindrical member 480 can be threaded down onto a prior art wellhead fitting (not shown).

Figure 4:
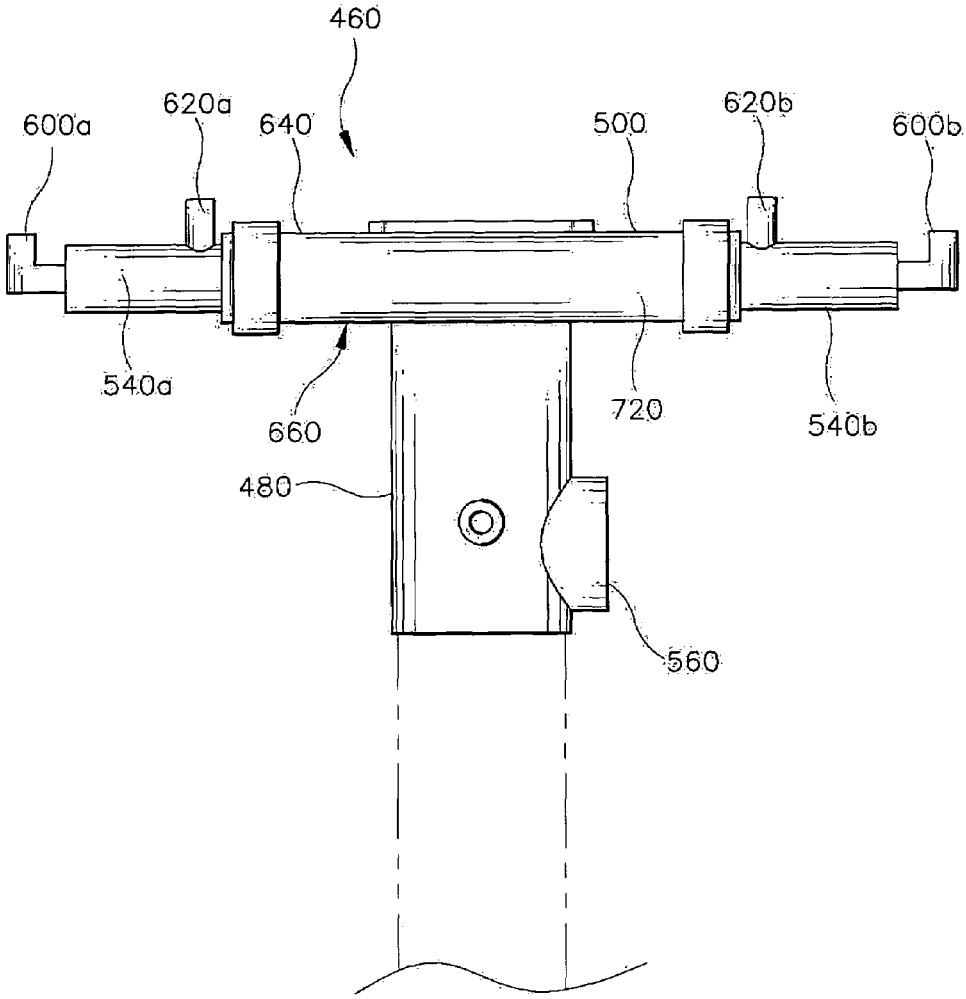
FIG. 4 is a side view of the wellhead safety valve system shown in FIG. 2.
Figure 4A:
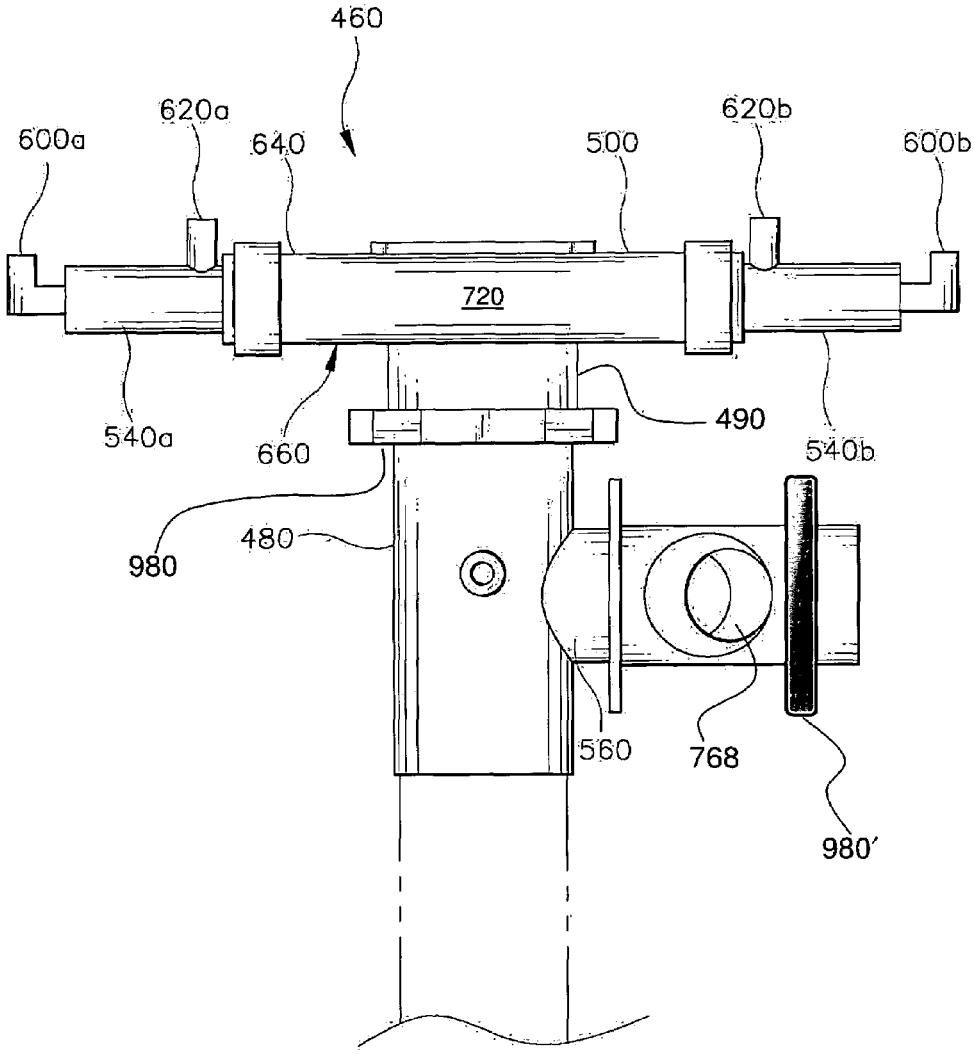
FIG. 4A is a side view of a wellhead safety valve system with a hammer union according to the present invention.
Figure 5:
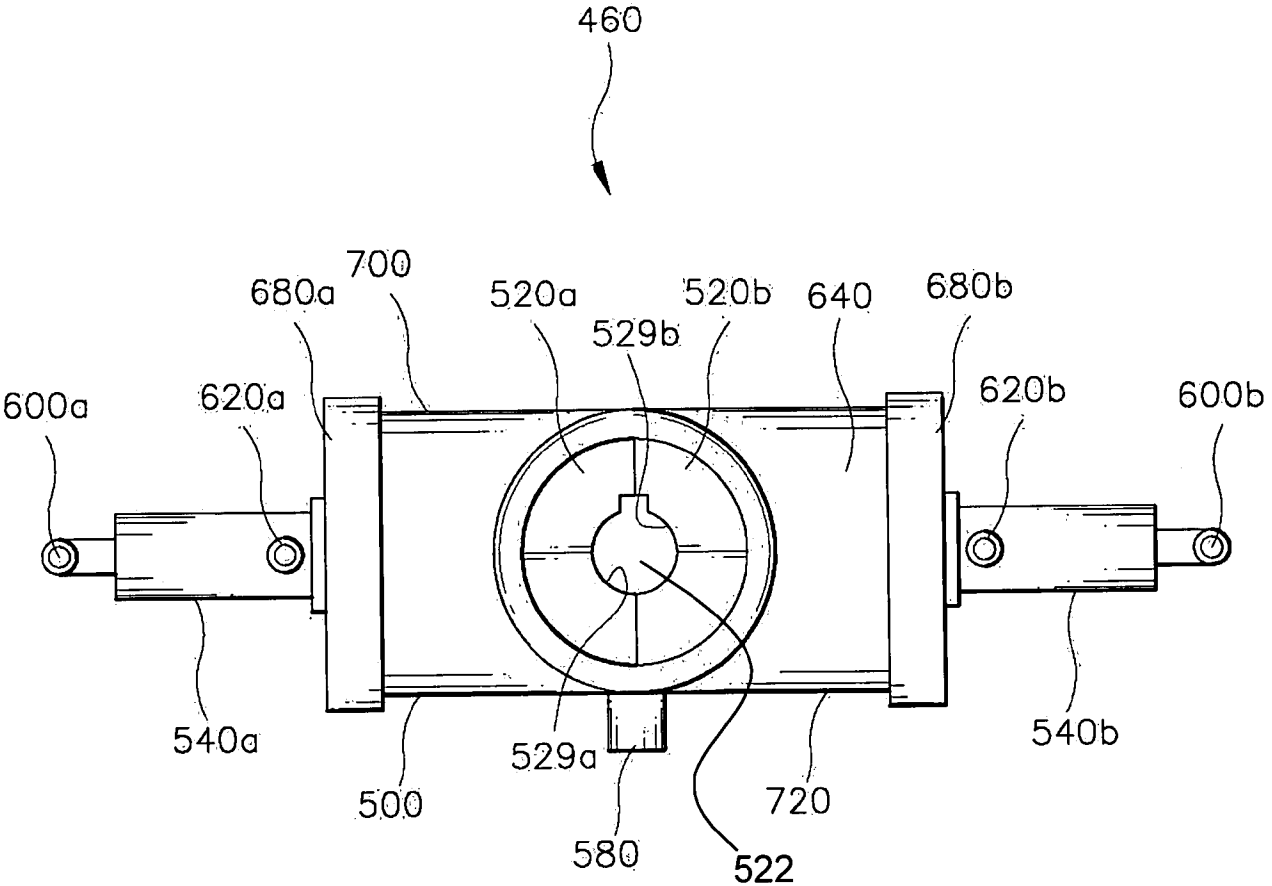
FIG. 5 is a top view of the wellhead safety valve system shown in FIG. 2.

Alternatively, the valve system 460 can further comprise a cylindrical pillar of hollow bore 490 fitted in communion with the lower aperture 670 in lower sidewall 660. A hammer union 980 can be fitted to the bottom of the cylindrical member 490. The hammer union 980 allows an operator to fit the valve 460 valve system directly to a well head using the hammer union 980 or to cylindrical member 480 as shown in FIG. 4A. The dimensions of the hammer union 980 can vary according to the dimensions of a particular wellhead 110.

Further hammer unions can be used in valve 460 such as optional hammer union 980' fitted to drilling fluid discharge outlet 560 as shown in FIG. 4A. Hammer unions are supplied, for example, by R&M Energy Systems (a unit of Robbins & Myers, Inc.), Customer Service, P.O. Box 2871, Borger, Tex., U.S.A. 79008-2871 (TEL: 800-858-4158, and FAX: 806-274-3418) and also in Canada at: R&M Energy Systems Canada, Customer Service 9830-45$^{th}$ Avenue, Edmonton, Alberta, Canada T6E 5C5 (TEL: 800-661-5659 and/or 780-437-6316, and FAX: 780-435-3074).

Figure 11:
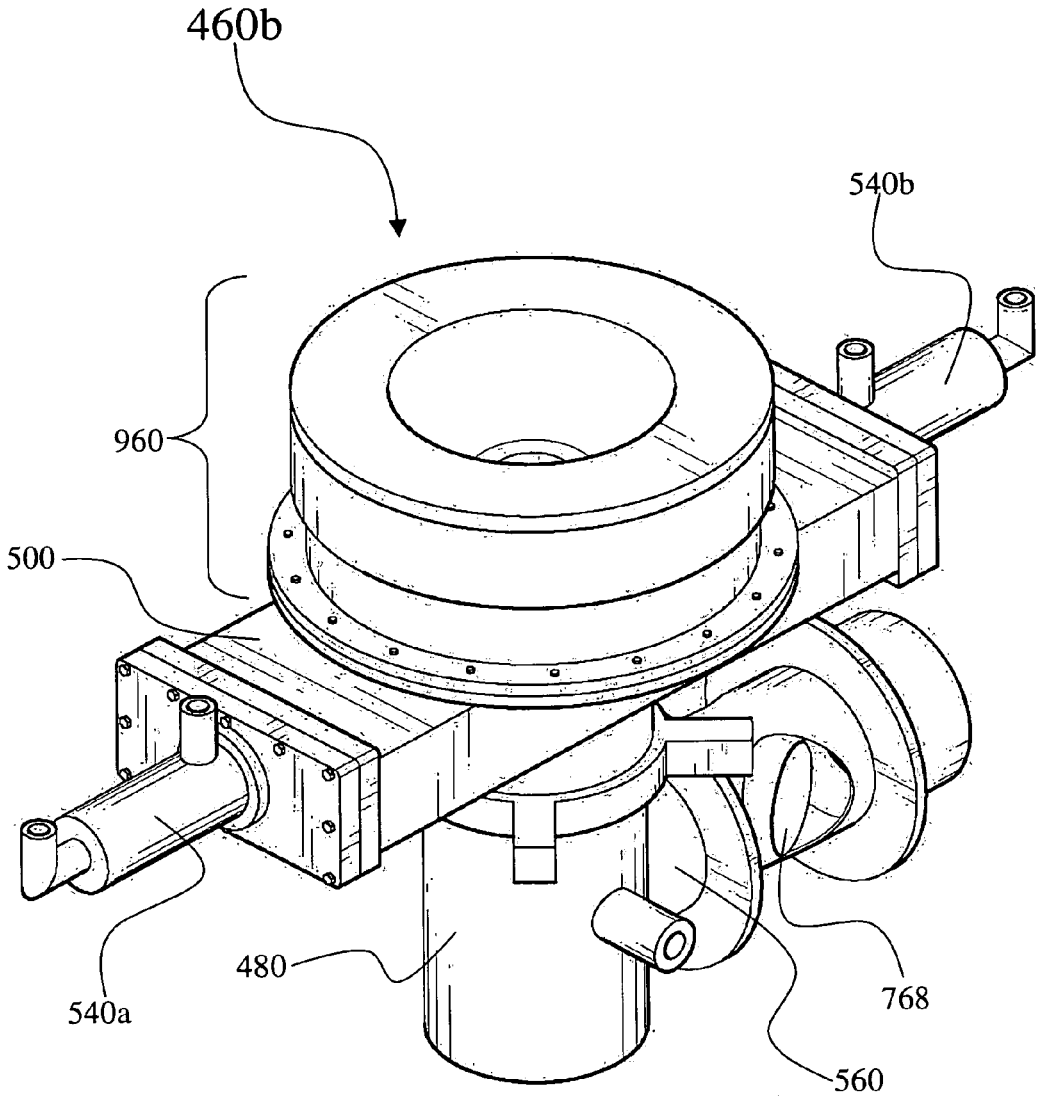
Figure 12:
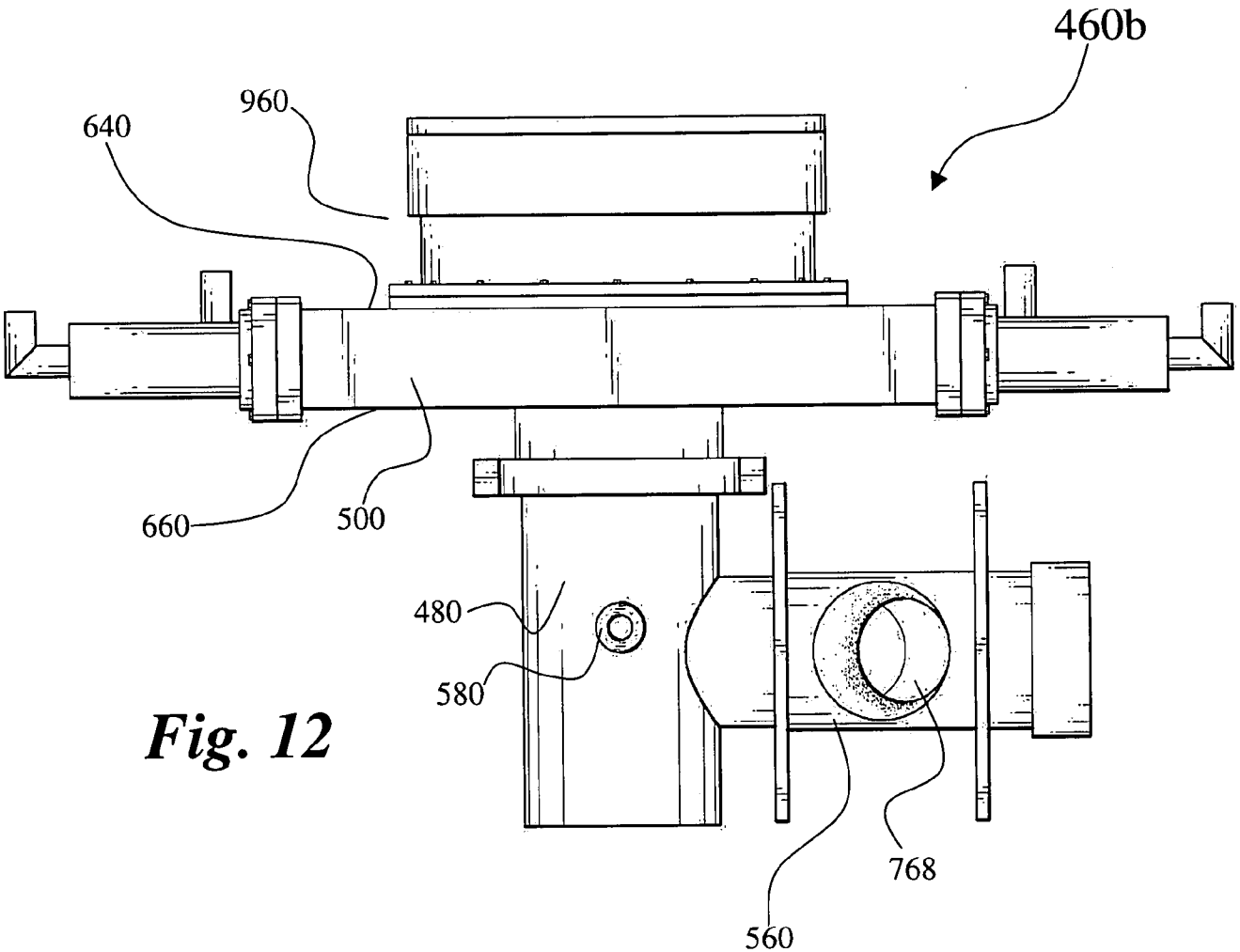
Figure 13:
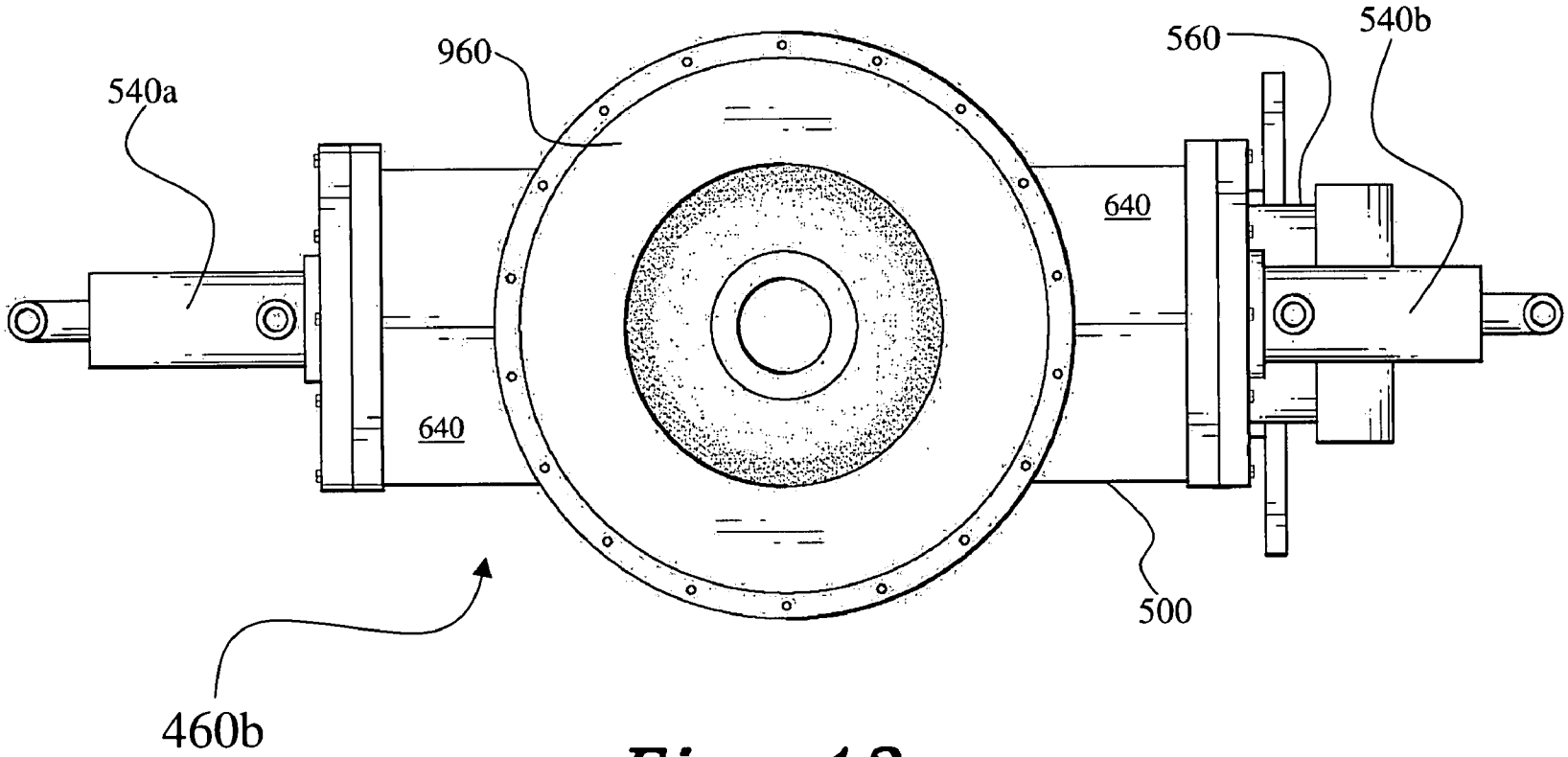

In at least one FIGURE, member 480 is shown fitted with a fresh water inlet 580 and a drilling fluid discharge outlet 560. The fresh water inlet 580 is used for water injection, i.e., inlet 580 allows an operator to direct water downhole into casing 180 and thence down into the large well bore 240 to help pushback methane into the coal seam 120. The water inlet 580 can be fitted with any suitable valve such as a ball valve (e.g., a 2 inch ball valve). Discharge outlet 560 can be fitted with a ball valve for controlled discharge of drilling fluid from the wellhead 110. A ball valve 768 can also be fitted to the outlet 560 such as, but not limited to, a 6 inch ball valve (see, for example, FIGS. 4A and 11).

It should be understood that the term "working fluid" refers to any fluid (including any suitable gas, including, but not limited to, air) that can be used to move the stuffer-blocks 520*a* and 520*b* towards and/or away from each other (i.e., between open and closed positions with respect to each other). If air is used as the working-fluid, it follows that an air-compressor/air-release system will be required to move the stuffer-blocks 520*a* and 520*b* between open and closed positions with respect to each other. Alternatively, a suitable working fluid such as that used in hydraulic systems may be used, in which case a hydraulic power unit would be used to move the stuffer-boxes 520*a* and 520*b* between open and closed positions (see FIGS. 2 and 3, respectively).

The blocks 520*a* and 520*b* respectively have rear-ends 525*a* and 525*b*, and front ends 527*a* and 527*b*. The front ends 527*a* and 527*b* respectively comprise recess 529*a* and 529*b*, which together can form a tight fit when required around, for example, conduit tubing when the blocks 520*a* and 520*b* are in closed configuration or position.

Figure 6:
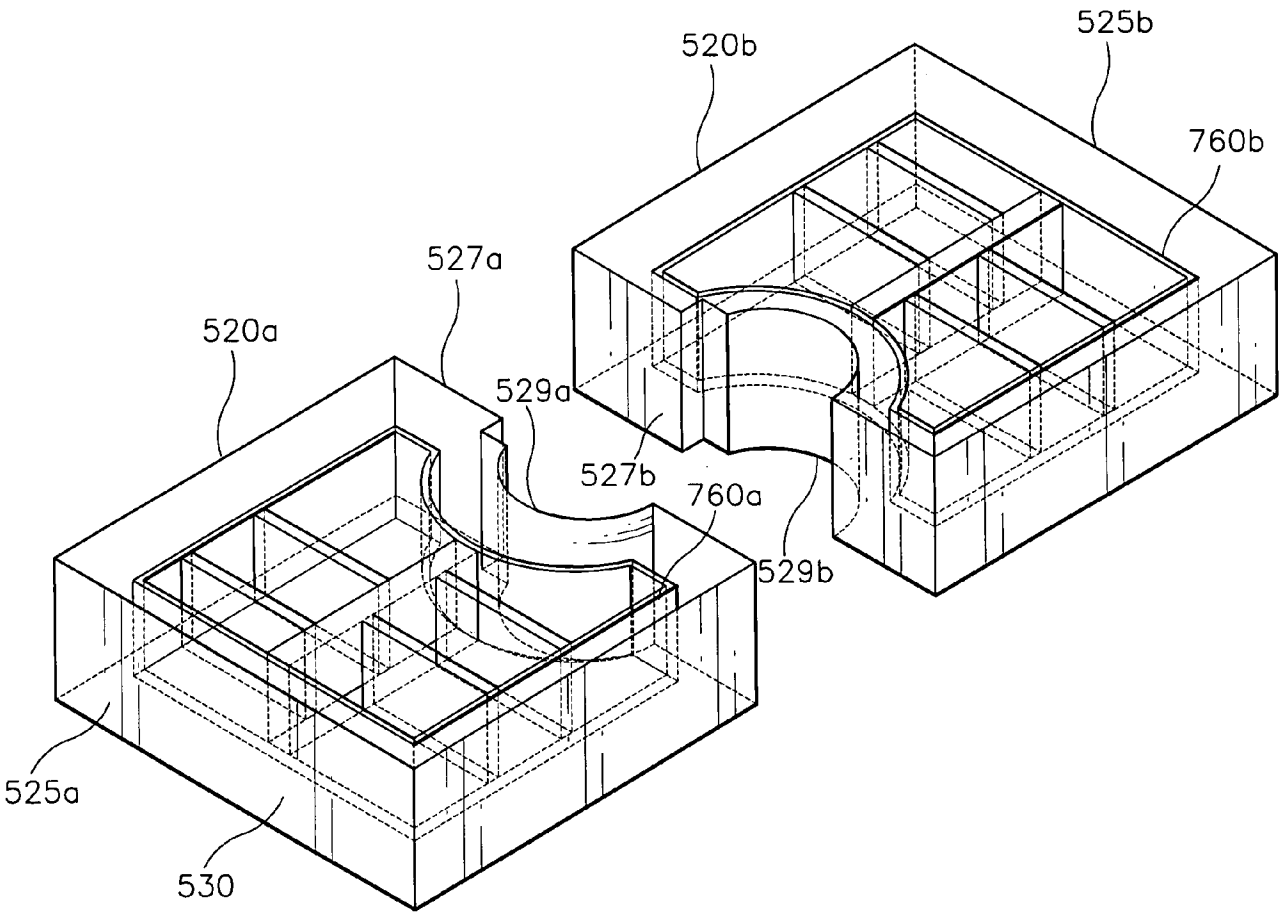
FIG. 6 is a partially cutaway view of a stuffer-block according to the present invention.
Figure 6A:
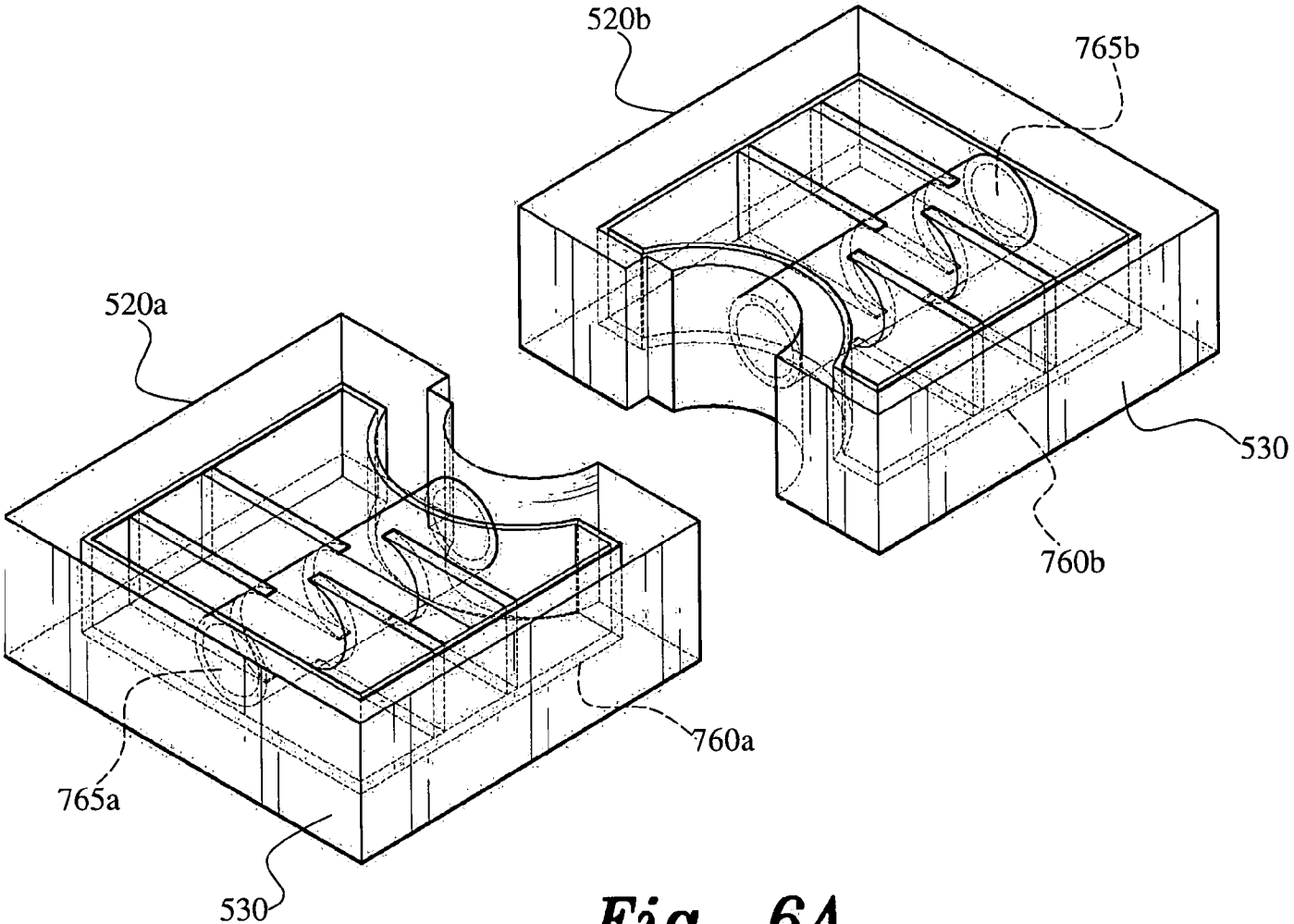
FIG. 6A is a partially cutaway view of a stuffer-block according to the present invention.
Figure 6B:
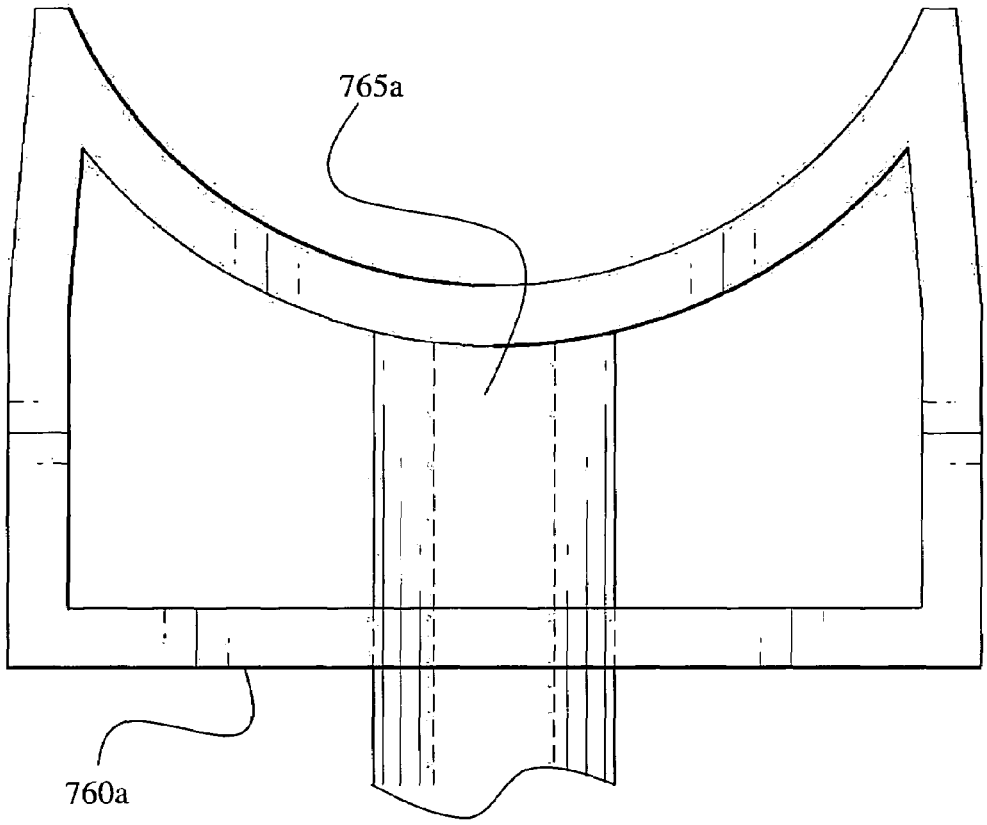
FIG. 6B is a top view of view of an internal stuffer-block frame according to the present invention.
Figure 6C:
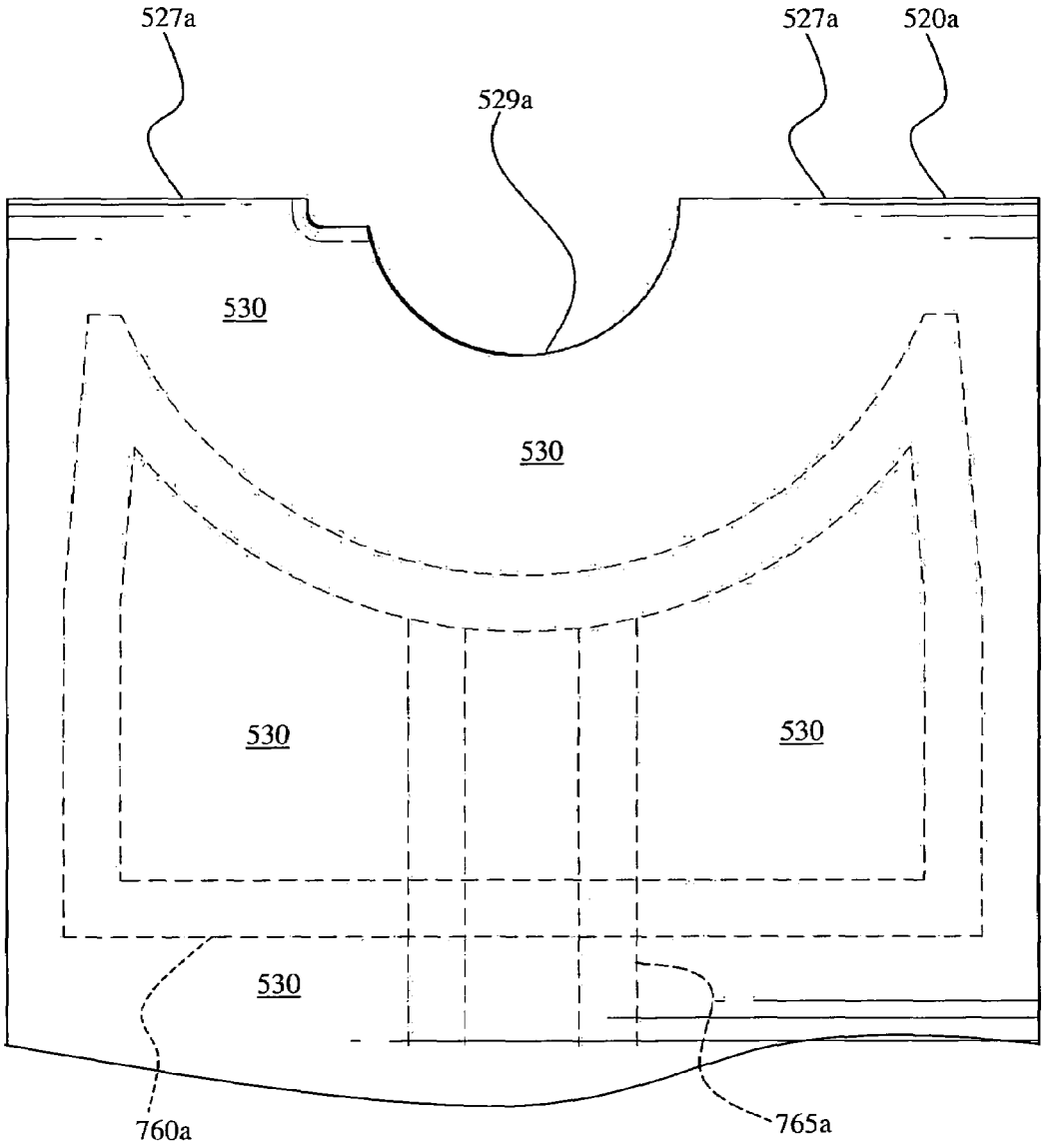
FIG. 6C is a partial view showing the internal structure of a stuffer-block according to the present invention.

The stuffer-blocks 520*a* and 520*b* comprise of a polymer material, such as rubber, with optional internal stuffer-box frame 760 (represented in the FIGURES as "760*a*" and/or "760*b*") to add resilience to the stuffer-blocks 520*a* and 520*b*. For example, FIG. 6 shows a partially cutaway view of the stuffer-blocks 520*a* and 520*b* revealing optional internal stuffer-box frames 760*a* and 760*b*, respectively, covered in polymer 530 such as rubber. The internal stuffer-box frames 760*a* and 760*b* can be made of any suitable material such as compression resistant plastic or metal such as metal alloy, e.g., steel. The internal stuffer-box frames 760*a* and/or 760*b* may include an optional internal stuffer-box framework sleeves 765*a* and 765*b*, respectively, as shown, for example, in FIGS. 6 through 6C. The optional internal sleeves 765 may comprise an internal thread. The optional internal sleeves 765*a* and 765*b* can be made of any suitable material such as, but not limited to, steel. The dimensions of the optional sleeves 765*a* and 765*b* may vary. Each optional sleeve 765*a* and 765*b* may have different dimensions such as different lengths, and/or different inner and outer diameters with respect to each other. The outer diameter of each optional sleeve will naturally be greater than each corresponding inner diameter. For example, sleeve 765*a* may have an inner diameter of about one inch and an outer diameter of about 1.5 inches.

When the stuffer-blocks 520*a* and 520*b* are in a closed configuration (see, for example, FIG. 2), they provide a good seal around, for example, water extraction conduit 280 thereby sealing the wellhead 110 in the event of unsafe methane build up in or around the wellhead 110.

The internal metal frames 760*a* and 760*b* can be made out of any suitable material such as any suitable metal or metal alloy, alone or in combination. For example, the internal metal frames 760*a* and 760*b* can be fabricated out of any suitable steel such as, but not limited to: low-carbon steels that contain up to 0.30 weight percent carbon (C); medium-carbon steels with C ranges from 0.30 to 0.60 weight percent and the manganese (Mn) from 0.60 to 1.65 weight percent; high-carbon steels that contain from 0.60 to 1.00 weight percent C with Mn contents ranging from 0.30 to 0.90 weight percent; high-strength low-alloy (HSLA) steels with low carbon contents (0.50 to ~0.25 weight percent C) and Mn contents up to 2.0 weight percent with small quantities of chromium, nickel, molybdenum, copper, nitrogen, vanadium, niobium, titanium, and zirconium, alone or in combination.

Figure 8:
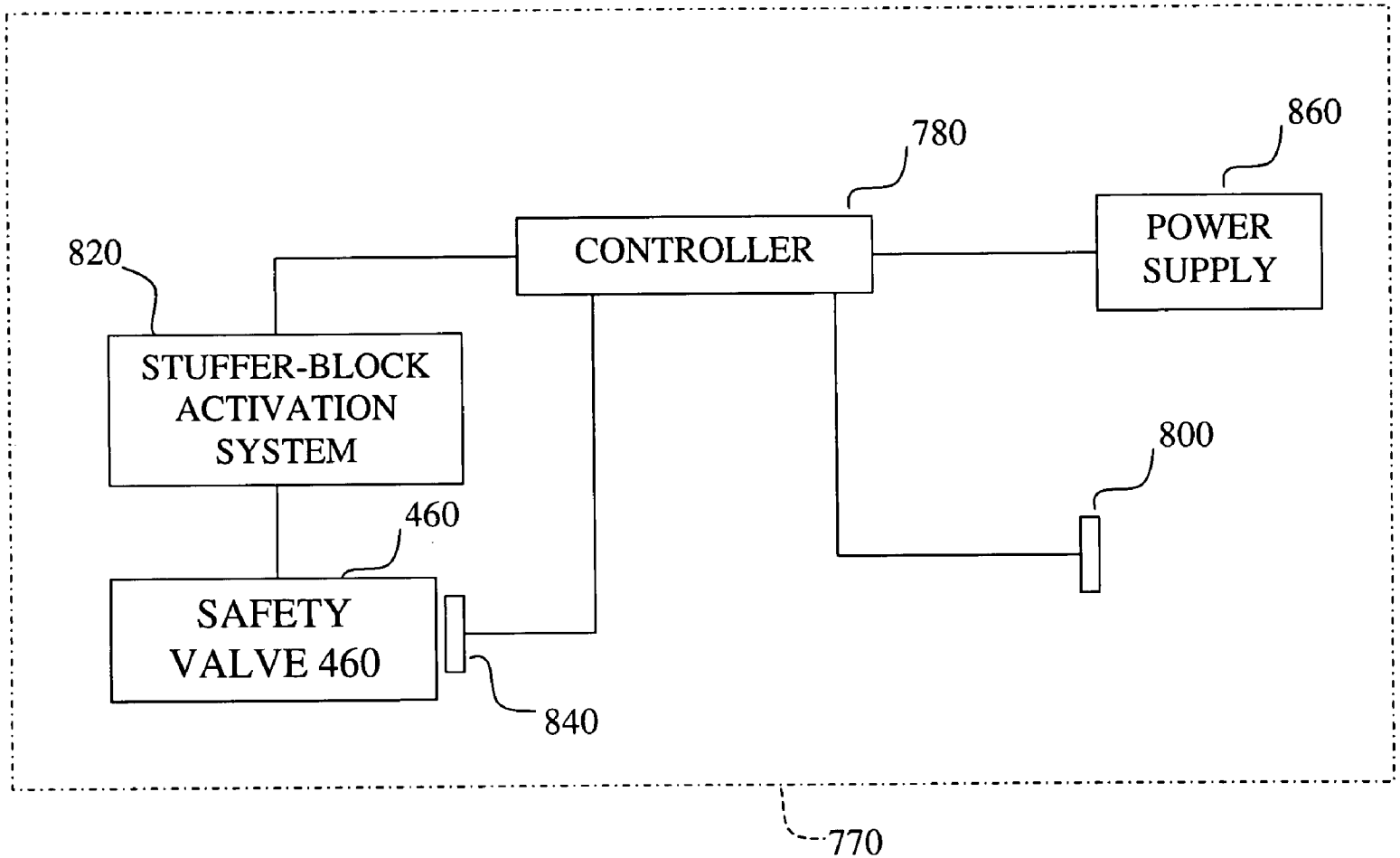
FIG. 8 is a schematic of an automatic control system, according to the present invention.

FIG. 8 is a schematic of an automatic control system, according to the present invention. More specifically, FIG. 8 is a schematic showing how the safety valve system 460 can be operated as an integrated hardware/software system 770, wherein a controller 780, which is adapted to perform logical operations, is connected to: at least one methane sensor 800, a stuffer-block activation system 820, a stuffer-box position sensor 840, and a power supply 860. The controller 780 includes a processor and sufficient memory (or access to sufficient memory) to perform the logic steps necessary to operate the integrated system 770. The at least one methane sensor 800 can be any suitable methane sensor such as a methane sensor from CAPSUM adapted for long-term deployment (antifouling membrane, self calibration capability) and deeper capability; CAPSUM Technologie GmbH, Max-Planck-Strabe, 21502 Geesthacht, Germany (Tel: +49-(0)4152-889220; Fax: +49-(0)4152-889200). The methane sensor 800 may be located at any suitable point inside the well 100, e.g., along the casing 180 and could take the form of a remote fiber-optic methane monitor such as, but not limited to, optical fiber Raman spectroscopy based methane detectors available from Well-Dog, Inc. of Laramie, Wyo. 82070 (TEL: (307) 721-8875, FAX: (307) 742-0943); see U.S. Pat. No. 6,678,050, issued Jan. 13, 2004 to Pope et al., which describes a method of measuring methane using a spectrometer in a coal-bed methane well; U.S. Pat. No. 6,678,050 is herein incorporated by reference in its entirety. The methane sensor 800 could be of the catalytic pellistor type, in which the methane is catalytically oxidized as described in U.S. Pat. No. 4,485,666, issued Dec. 4, 1984 to Higgins et al. The at least one methane sensor 800 can be a permanent fixture of the well 100 and provide methane quantitative data both to the logic controller 780 and to other equipment such as production reporting devices or other logic controllers linked to additional safety monitoring equipment.

Figure 7:
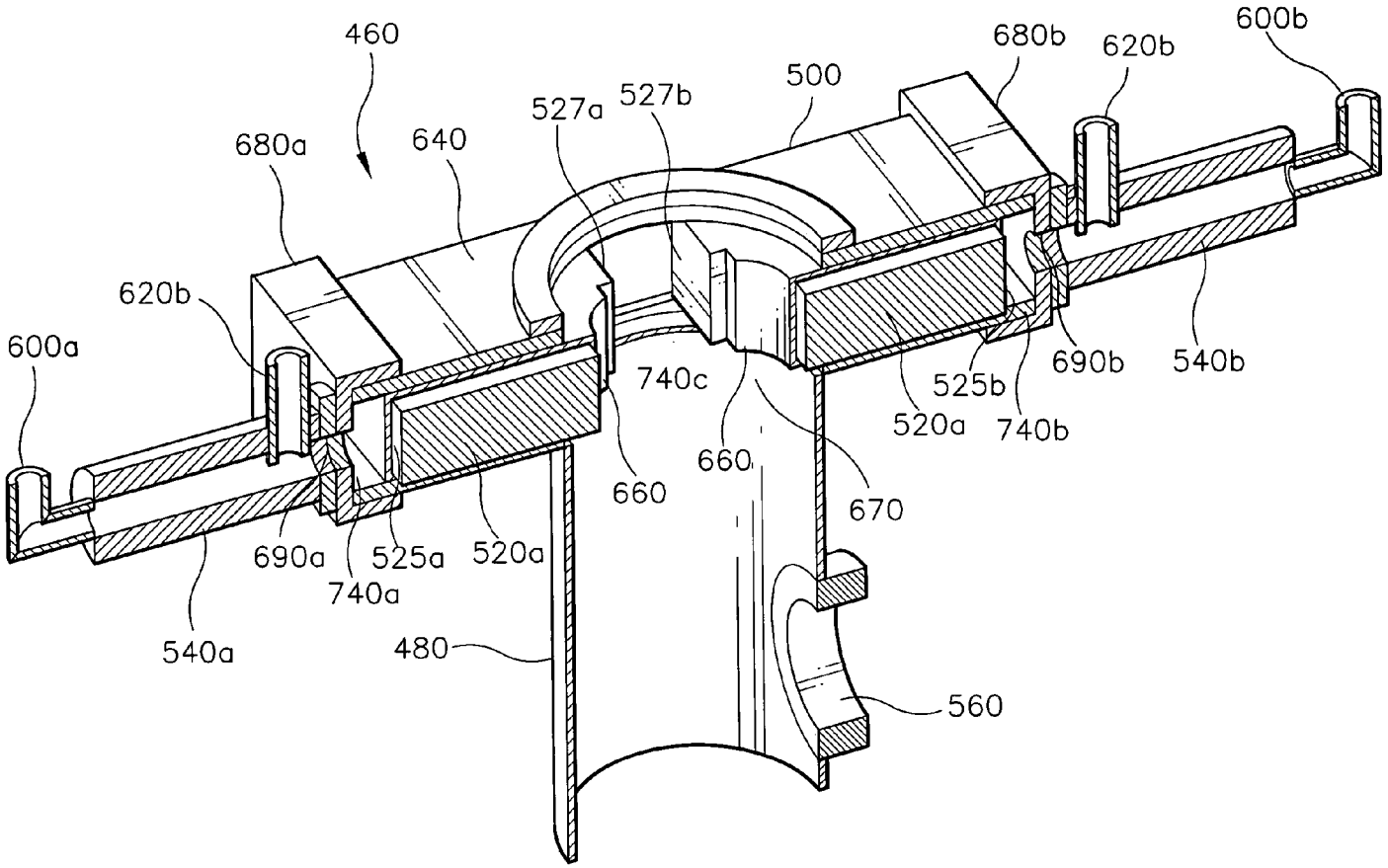
FIG. 7 is a cross-sectional view of a wellhead safety valve system according to the present invention.

The stuffer-block activation system 820 is in operable communication with stuffer-block 520*a* via member 540*a*, and more specifically via ports 600*a* and 620*a*, and with stuffer-block 520*b* via member 540*b*, and more specifically via ports 600*b* and 620*b* (as shown in, e.g., FIG. 7). The stuffer-block activation system 820 delivers (and optionally removes) working fluid to move the stuffer-blocks between open and closed positions (and/or between closed and open positions). For example, the stuffer-block activation system 820 might deliver compressed air (e.g., at about 100 psi to about 2,500 psi) with the closing force working against rear-ends 525*a* and 525*b* of stuffer-blocks 520*a* and 520*b*, respectively.

Figure 9:
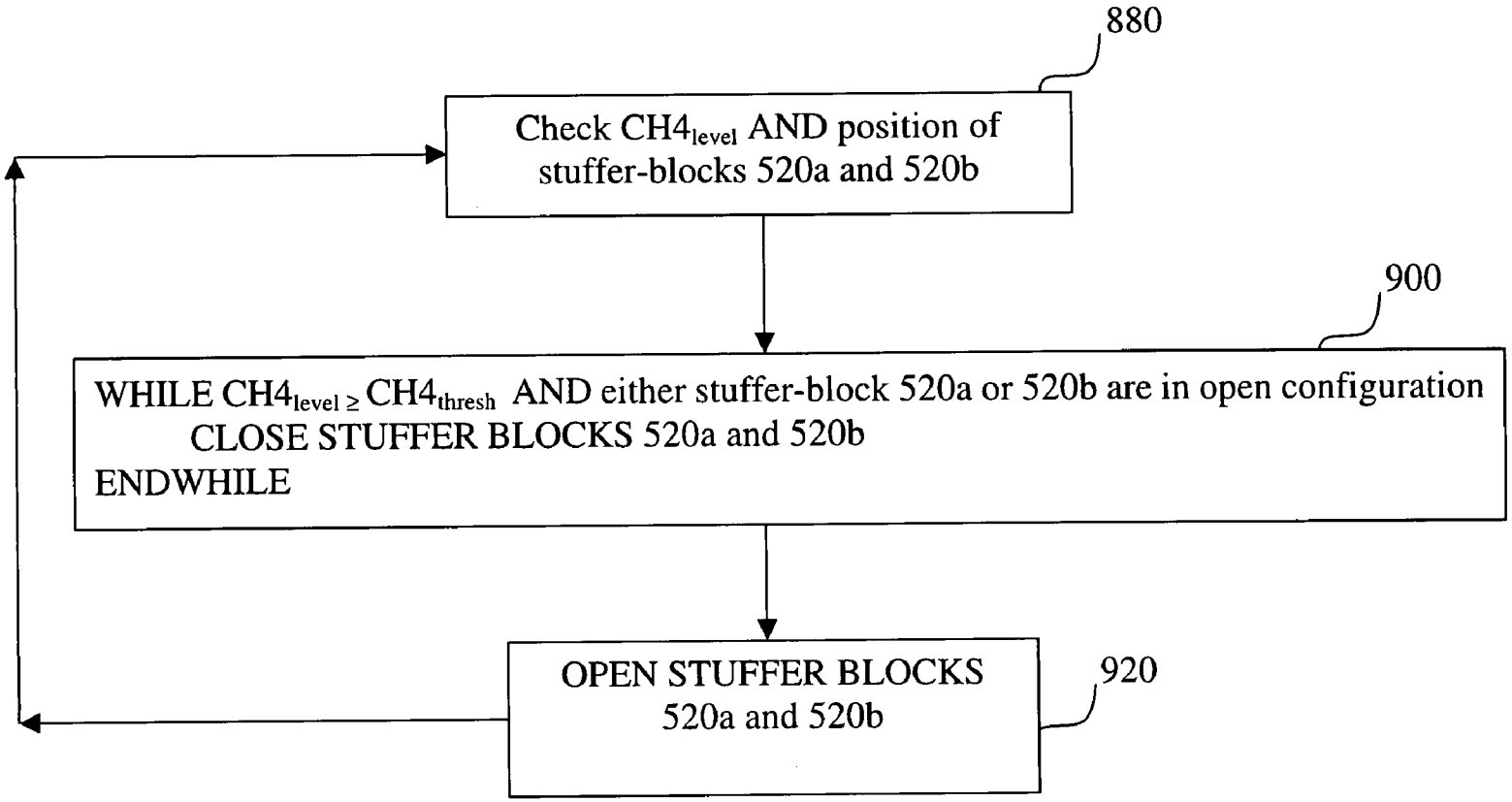
FIG. 9 shows a flowchart with logical steps according to the present invention.

FIG. 9 shows the type of logical steps employed by controller 780. More specifically, a control algorithm is stored on the controller 780 and the controller 780 operates in response to the control algorithm, wherein the control algorithm includes the logic steps as outlined in FIG. 9. Alternatively, the control algorithm can be stored on a memory chip in communication with the controller 780. The controller 780 can take the form of a Programmable Logic Controller (PLC) Suitable Programmable Logic Controllers are available from several suppliers such as, but not limited to, Allen-Bradley (Allen-Bradley & Rockwell Software Brands, 1201 South Second Street, Milwaukee, Wis. 53204-2496, USA).

Still referring to FIG. 9, the level or concentration of methane ("$CH4_{level}$") and the position of the stuffer-blocks 520*a* and 520*b* are checked at 880. While $CH4_{level}$ is equal to or greater than a predetermined threshold value ("$CH4_{thresh}$") and either stuffer-block 520*a* or 520*b* are in open configuration or position, the stuffer-blocks 520*a* and 520*b* are moved into the closed configuration or position by stuffer-block activation system 820 (under instruction from controller 780) at 900. Once $CH4_{level}$ is below $CH4_{thresh}$, the stuffer blocks 520*a* and 520*b* are moved to open configuration at 920 to facilitate removal of the submersible water pump 260. The predetermined threshold value of methane can be any suitable value that indicates an actual or potential methane issue, e.g., a concentration of methane of about x % or more, wherein x is selected from the following list: about 1% or more, about 2% or more, about 3% or more, about 4% or more, about 5% or more, or about 10% or more. Obviously, methane levels that may be tolerated lower in the well 100 can be unacceptable if detected, for example, at the wellhead 110 or at the earth's surface 160 near the wellhead 110. Thus, the stuffer-blocks 520*a* and 520*b* are quickly and automatically closed whenever there is a methane threat issue and are opened when there is not a methane threat issue.

Figure 10:
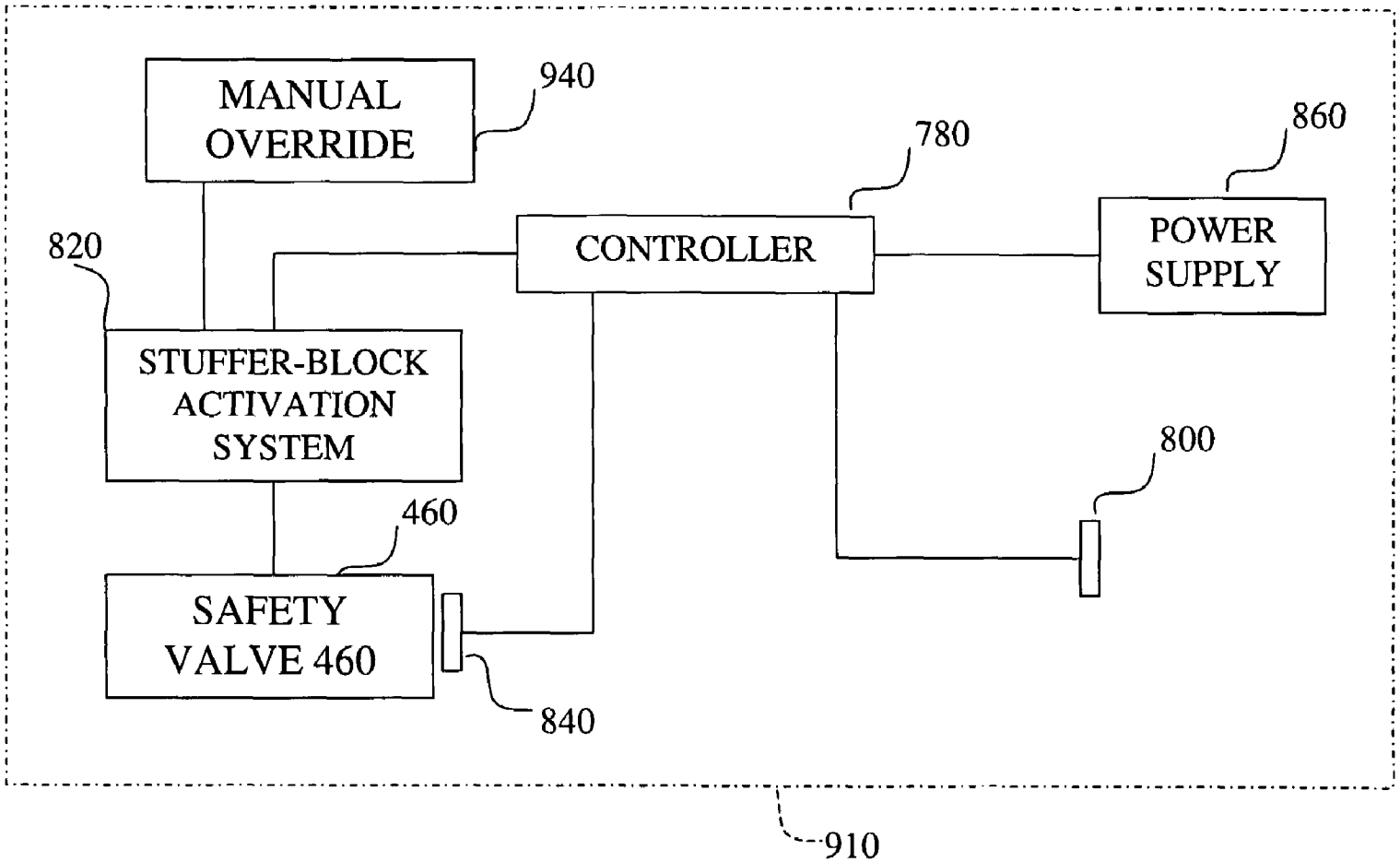
FIG. 10 is a schematic of a manual override/automatic control system, according to the present invention.

FIG. 10 is a schematic of a manual override/automatic control system 910 according to the present invention. A manual override system 940 provides human workers to control the opening and closings of the stuffer-blocks 520*a* and 520*b*. Thus, human operators have a choice of either manually or automatically varying the open/closed configuration of the stuffer-blocks 520*a* and 520*b*.

The CBM wellhead 110 may vary in shape and construction. However, for a typical CBM wellhead 110, the safety valve system 460 of the present invention may be fitted as follows: (1) first removing the water discharge and measurement piping from the wellhead 110; (2) removing the wellhead fitting top nut to expose the wellhead mandrel; and (3) the safety valve system 460 of the present invention is then set down on the wellhead fitting and the wellhead swivel is threaded down on the wellhead mandrel, which is lifted up through the safety valve system 460 of the present invention. The human operator is now able to place pipe slips on top of the safety valve system 460, and the human operator is now free to pull the down-hole tubing and submersible water pump 260 up and out of the well 100. Prior to fitting the safety valve system 460 to the wellhead 110, it is first prudent to pump water down into the bore 240 to create a temporary reverse positive water pressure in the space around the bore 240 to help prevent significant seepage of methane into the well 100 and thence the wellhead 110. In the event that significant or dangerous methane levels reach the wellhead 110, the stuffer-blocks 520*a* and 520*b* are moved into closed configuration (see FIG. 2). Otherwise the stuffer-blocks 520*a* and 520*b* are maintained in an open configuration (see FIG. 3).

Figure 14:
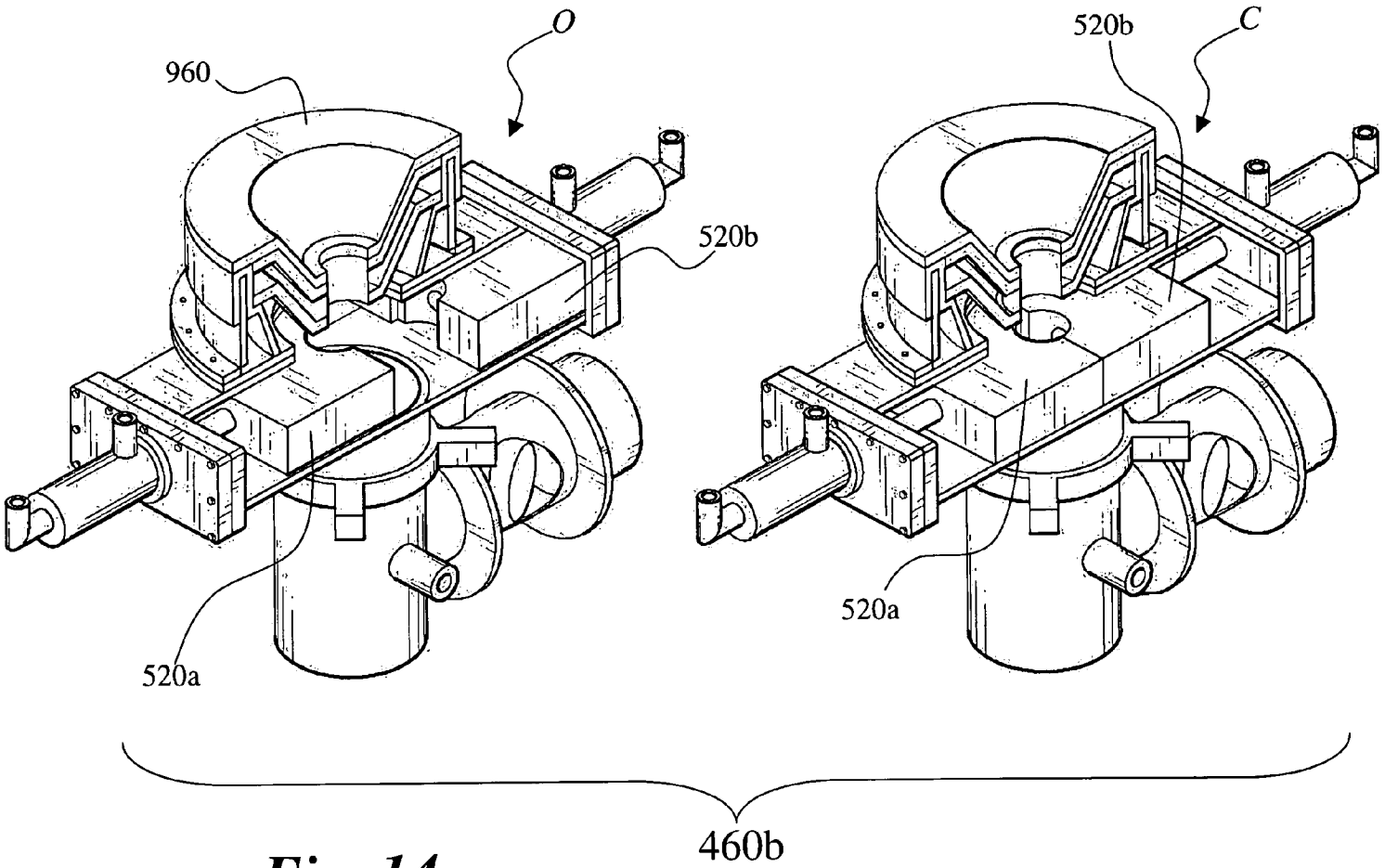

FIGS. 11 through 14 show a further embodiment of the valve of the present invention (represented by alpha-numeric label "460*b*"), wherein a top portion 960 is a free-rotating stripper-diverter the purpose of which is to divert, for example, drilling fluids and cuttings from the well out of the discharge outlet member 560. In FIG. 14, the stuffer-blocks 520*a* and 520*b* in valve 460*b* are shown in an open position O and a closed position C.

It is to be understood that the present invention is not limited to the embodiments described above, but encompasses any and all embodiments within the scope of the following claims.

What is claimed is:

1. A safety valve system for enabling the removal of down-hole tools such as a submersible water pump from a coal-bed methane well, comprising:

first and second horizontally opposed stuffer-blocks, wherein each of said first and second stuffer-blocks has opposite rear and front ends, wherein each of said front ends comprises a recess;

a stuffer-box housing for housing said stuffer-blocks, said housing having an interior volume;

means for attaching said stuffer-box housing to a coal-bed methane wellhead;

means for delivering fluid to move said opposed stuffer-blocks between an open position and a closed position, such that when said first and second stuffer-blocks are in the closed position said stuffer-block front ends define an aperture; and a controller, at least one methane sensor, a stuffer-box position sensor, and a stuffer-block activation system, wherein a control algorithm is stored on or in communication with said controller, further wherein said controller operates in response to said control algorithm, wherein said stuffer-box position sensor determines the position of at least one of said stuffer-blocks and reports this information to said controller, and wherein said at least one methane sensor reports methane concentration data to said controller, and further wherein, using said algorithm and based on a predetermined methane threshold value, said controller determines whether the stuffer-block activation system should move said stuffer-blocks into an open configuration or a closed configuration.

2. The safety valve system of claim 1, wherein said means for attaching said stuffer-box housing to a coal-bed methane wellhead comprises a cylindrical pillar.

3. The safety valve system of claim 1, wherein each of said first and second stuffer-blocks comprises an internal stuffer-box frame.

4. The safety valve system of claim 1, wherein each of said first and second stuffer-blocks comprises an internal stuffer-box frame, and wherein each internal stuffer-box frame is embedded in a polymer.

5. The safety valve system of claim 1, wherein each of said first and second stuffer-blocks comprises an internal stuffer-box frame, and wherein each internal stuffer-box frame is embedded in a polymer, wherein said polymer is rubber.

6. The safety valve system of claim 1, further comprising a free-rotating stripper-diverter.

7. The safety valve system of claim 1, further comprising a manual override system to allow a human operator to move said first and second stuffer-blocks between an open configuration and a closed configuration and vice versa.

8. The safety valve system of claim 1, wherein each of said stuffer-blocks comprises a metal frame, and wherein said metal frame assists said stuffer-blocks in resisting compression loads.

9. A safety valve system for enabling removal of down-hole tools such as a submersible water pump from a coal-bed methane well, comprising:

first and second horizontally opposed stuffer-blocks, wherein each of said first and second stuffer-blocks has opposite rear and front ends, wherein each of said front ends comprises a recess which together can form a tight fit when required around conduit tubing, wherein said stuffer-blocks can move between an open configuration and a closed configuration;

a stuffer-box housing for housing said stuffer-blocks, said housing having an interior volume;

a wellhead attachment member for attaching stuffer-box housing to a coal-bed methane wellhead;

first and second working fluid in/out members;

a controller;

at least one methane sensor;

a stuffer-box position sensor; and a stuffer-block activation system, wherein a control algorithm is stored on or in communication with said controller, further wherein said controller operates in response to said control algorithm, wherein said stuffer-box position sensor determines the position of at least one of said stuffer-blocks and reports this information to said controller, and wherein said at least one methane sensor reports methane concentration data to said controller, further wherein, using said algorithm and based on a predetermined methane threshold value, said controller determines whether said stuffer-block activation system should move said stuffer-blocks into an open configuration or a closed configuration.

10. A safety valve system for enabling removal of a submersible water pump from a coal-bed methane well, comprising:

first and second horizontally opposed stuffer-blocks, wherein each of said first and second stuffer-blocks has opposite rear and front ends, wherein each of said front ends comprises a recess which together can form a tight fit when required around conduit tubing, wherein said stuffer-blocks can move between an open configuration and a closed configuration;

a stuffer-box housing for housing said stuffer-blocks, said housing having an interior volume;

a wellhead attachment member for attaching said stuffer-box housing to a coal-bed methane wellhead;

first and second working fluid in/out members;

a controller;

at least one methane sensor; a stuffer-box position sensor; and a stuffer-block activation system, wherein a control algorithm is stored on said controller, further wherein said controller operates in response to said control algorithm, wherein said stuffer-box position sensor determines the position of at least one of said stuffer-blocks and reports this information to said controller, and wherein said at least one methane sensor reports methane concentration data to said controller, further wherein using said algorithm and based on a predetermined methane threshold value, said controller determines whether said stuffer-block activation system should move said stuffer-blocks into an open configuration or a closed configuration, wherein said safety valve system further comprises a manual override system to allow a human operator to move said first and second stuffer-blocks between an open configuration and a closed configuration and vice versa.

11. A safety valve system for enabling the removal of down-hole tools such as a submersible water pump from a coal-bed methane well, comprising:

first and second horizontally opposed stuffer-blocks, wherein each of said first and second stuffer-blocks has opposite rear and front ends, wherein each of said front ends comprises a recess which together can form a tight fit when required around conduit tubing, wherein said stuffer-blocks can move between an open configuration and a closed configuration;

a stuffer-box housing for housing said stuffer-blocks, said housing having an interior volume;

means for attaching said stuffer-box housing to a coal-bed methane wellhead;

means for delivering fluid to move said opposed stuffer-blocks between an open position and a closed position;

a controller, at least one methane sensor, a stuffer-box position sensor, and a stuffer-block activation system, wherein a control algorithm is stored on or in communication with said controller, further wherein said controller operates in response to said control algorithm, wherein said stuffer-box position sensor determines the position of at least one of said stuffer-blocks and reports this information to said controller, and wherein said at least one methane sensor reports methane concentration data to said controller, and further wherein, using said algorithm and based on a predetermined methane threshold value, said controller determines whether the stuffer-block activation system should move said stuffer-blocks into an open configuration or a closed configuration: and a free-rotating stripper-diverter.

* * * * *